US008833349B2

(12) United States Patent
Park

(10) Patent No.: US 8,833,349 B2
(45) Date of Patent: Sep. 16, 2014

(54) SMALL-SCALE COMPOUND BOW

(76) Inventor: Kyung Sin Park, Cheonnan-si (KR)

( * ) Notice: Subject to any disclaimer, the term of this patent is extended or adjusted under 35 U.S.C. 154(b) by 156 days.

(21) Appl. No.: 13/578,076

(22) PCT Filed: Feb. 10, 2011

(86) PCT No.: PCT/KR2011/000882

§ 371 (c)(1),
(2), (4) Date: Aug. 9, 2012

(87) PCT Pub. No.: WO2011/102616

PCT Pub. Date: Aug. 25, 2011

(65) Prior Publication Data

US 2012/0312287 A1 Dec. 13, 2012

(30) Foreign Application Priority Data

| | | |
|---|---|---|
| Feb. 17, 2010 | (KR) | 10-2010-0014042 |
| Feb. 22, 2010 | (KR) | 10-2010-0015607 |
| Mar. 16, 2010 | (KR) | 10-2010-0023200 |
| Apr. 16, 2010 | (KR) | 10-2010-0035300 |
| Oct. 23, 2010 | (KR) | 10-2010-0103749 |

(51) Int. Cl.
*F41B 5/10* (2006.01)
*F41B 5/00* (2006.01)

(52) U.S. Cl.
CPC ..... *F41B 5/10* (2013.01); *F41B 5/0094* (2013.01); *F41B 5/105* (2013.01)
USPC ..... 124/25.6

(58) Field of Classification Search
USPC ..... 124/25.6, 900
See application file for complete search history.

(56) References Cited

U.S. PATENT DOCUMENTS

| | | | | |
|---|---|---|---|---|
| 4,338,910 A * | 7/1982 | Darlington | ..... | 124/25.6 |
| 4,457,288 A | 7/1984 | Ricord | | |
| 4,461,267 A * | 7/1984 | Simonds et al. | ..... | 124/25.6 |
| 4,903,677 A | 2/1990 | Colley et al. | | |

(Continued)

FOREIGN PATENT DOCUMENTS

KR 10-1998-0082317 12/1998

OTHER PUBLICATIONS

International Search Report for PCT/KR2011/000882 Mailed on Oct. 31, 2011.

*Primary Examiner* — John Ricci
(74) *Attorney, Agent, or Firm* — AKC Patents LLC; Aliki K. Collins

(57) ABSTRACT

The present invention relates to archery, and more specifically relates to a compound bow of reduced size and weight comprising short limbs (Li), small pulleys and small cams while maintaining the performance of the prior art by linking a differential motion cam and a differential motion pulley of a novel design. The present invention has devised a method for dispensing with large cams and decreasing the scale of compound bows by using three different stratagems. The compound bow is decreased in scale through 1. the use of an idler pulley (IP) and a differential motion cam which rotates by a large extent as shown in FIG. 3, 2. the use of both a Y-cam (YC) which rotates by a large extent and a differential motion cam as shown in FIG. 11, and 3. the use of a combination of Y-cams (YC) which rotate by a large extent as shown in FIG. 16; and this compound bow can be used, by way of example, for hunting and sports and for shooting ropes for life saving purposes.

8 Claims, 24 Drawing Sheets

(56) References Cited

U.S. PATENT DOCUMENTS

| | | | | |
|---|---|---|---|---|
| 5,054,463 | A * | 10/1991 | Colley et al. | 124/25.6 |
| 7,047,958 | B1 * | 5/2006 | Colley | 124/25.6 |
| 7,971,582 | B1 * | 7/2011 | Larson | 124/25.6 |
| 2009/0000606 | A1 | 1/2009 | Cooper et al. | |
| 2009/0293854 | A1 | 12/2009 | Evans | |
| 2012/0006310 | A1 * | 1/2012 | Sims et al. | 124/25 |

* cited by examiner

SMALL-SCALE COMPOUND BOW

RELATED APPLICATIONS

This application is a 371 application of International Application No. PCT/KR2011/000882, filed Feb. 10, 2011, which in turn claims priority from Korean Patent Application Nos. 10-2010-0103749, filed Oct. 23, 2010, 10-2010-0035300, filed Apr. 16, 2010, 10-2010-0023200, filed Mar. 16, 2010, 10-2010-0015607, filed Feb. 22, 2010, and 10-2010-0014042, filed Feb. 17, 2010, each of which is incorporated herein by reference in its entirety.

TECHNICAL FIELD

The present invention relates to archery, and in particular to a small scale compound bow which is equipped with a differential motion pulley and a differential motion cam.

BACKGROUND ART

A compound bow has been being improved for almost 40 years since its invention in 1969 as the size of it has become compact-sized whereas forgiveness is being enhanced, and the speed of an arrow becomes faster.

The above-mentioned improvements thank to the use of new materials and new designs of cam.

The cams of a compound bow play an important role in terms of let-off and energy storage.

In the original compound bow, only one eccentric cam was used at an end portion of a limb of one side; however as the compound bow is improved, the construction of the cam is complicated. In recent years, a differential motion cam is generally used, in which two cams are engaged at an end portion of a limb.

In the original compound bow, since a distance between the axles (A to A; Axle to Axle) was long, so a relatively smaller cam and a relatively weaker limb and a riser could be used; however as the compound bow becomes compact-sized, the size of a cam has increased, and a stronger limb and a riser are needed. So, the weight of a compound bow has increased even though new materials are adapted.

The riser represents a part including a grip, and not includes limbs and a string. In the present invention, a riser outwardly extended from where a conventional limb was attached is used, and a riser propria (RP) means an inner side of a portion where a conventional limb was attached to a riser, and a riser extended (RE) means an outer side of a portion where a conventional limb was attached to. In addition, there is a riser supportive (RS) which is an element supporting a riser extended and a riser propria for the purpose of reducing the weight of a riser by distributing the force applied to the riser extended and the riser propria.

The outer circumference means a circumference of a circle as well as an ellipse and a groove of a cam, all of which hereinafter are used as the same meaning.

In case of a compound bow which has a small amount of limb movement, the length of a string to be released, which is wound on a groove of a cam and the distance between the axles are subject to determining a draw length in a large part. So, the string to be released, which is wound on the groove of the cam, is defined as a string releasable (SR).

The differential motion pulley means a pulley assembly formed of pulleys with different diameters and is generally used for the purpose of a speed change or a tensile force change. In the present invention, pulleys as well as cams are used. It is defined as a differential motion cam and includes a differential motion pulley. In the differential motion cam, a smaller cam is defined as a small lobe and a larger cam is defined as a large lobe.

The Y-shaped buss cable is generally used as a buss cable of a compound bow. In the present invention, a Y-shaped buss cable and a Y-shaped string are used, and a cam with a groove for fitting them is newly invented and adapted in the present invention, which is defined as a Y-cam. In case of a circular shape, it is defined as a Y-pulley; however it belongs to a Y-cam. One stem before it is branched from a Y-shape is defined as a Y-body, and two branches after it is branched are defined as a Y-limb.

The related technologies are as follows.

The U.S. Pat. No. 7,143,757 B1 Cooper Dec. 5, 2006 discloses a technology which is characterized in that a rotational amount of a cam module is possible up to 270° without a string being overlapped.

The U.S. Pat. No. 7,047,958 B1 David E. Colley May 23, 2006 discloses a technology which is characterized in that only an idler pulley is positioned at an end portion of a flexible limb, and a cam is positioned at a non-flexible riser, and a pulley adapted for a synchronization of upper and lower pulleys is positioned at a plane different from a flying direction of an arrow, thus making it possible to eliminate the member of a cable guard.

The WO 2008/108766 AI PCT/US2007/005834 SIMS, Steven, 1 Mar. 2007 discloses a technology which is characterized in that no pulley or cam is provided at an end portion of a flexible limb, and a differential motion cam is positioned at a non-flexible riser.

The Korean application number 10-2010-0023200 Park, Kyung-shin and Korean application number 10-2010-0036300 Park, Kyung-shin disclose the technologies which are directed to resolving the problems that the string is overlapped; however there are a lot of problems in the shaft of the cam.

DISCLOSURE OF INVENTION

The compound bow has become compact-sized since its invention in 1969.

"C" of FIG. 1 represents an improved compound bow with a shorter distance between axles, which compound blow adapts a way of increasing the circumference of a cam in an attempt to reduce the distance between the axles. In the compound bow which has a short distance between axles and a small amount of limb motion, the length of the string to be released, which is wound on a groove of a cam, plays a very important role in determining the draw length. As shown in FIG. 2, the cam used in the conventional compound bow has a rotational amount of a cam which does not exceed 270° after the drawing. A desired draw length can be maintained only when the size of the cam increases as long as the distance between axles (A to A; Axle to Axle) is getting shorter on the assumption that the rotational amount of the cam is not increased. Since a large cam made of a light metal is positioned at an end portion of a limb, it might be easily damaged.

The currently used compound bow has become compact-sized as compared with an original compound bow; however it is heavy, and a cam is thin and large, so it can be easily damaged.

The present invention is directed to making a compound bow compact-sized while not using a large size cam with the aid of the following three methods.

1. A differential motion cam with a large rotational amount as shown in FIG. 3 and an idler pulley are used.

2. A differential motion cam as shown in FIG. 11 and a Y-cam with a large rotational amount are together used.

3. A Y-cam with a large rotational amount as shown in FIG. 16 is used in combination.

The cam used in the above-mentioned methods has a large rotational amount, it is possible to maintain the same draw length even if the size of the cam is smaller than that of the conventional compound bow.

Advantageous Effects

The size of the differential motion cam installed at both ends of the limb according to the present invention is much smaller and thicker than the cam used in the recent compound bow with a short distance between axles. So, the size of the bow including the cam becomes smaller even when making the distance between axles identical, and the cam is less damaged. In addition, it is possible to manufacture a compound bow which has a short distance between axles as compared with a conventional compound bow.

The compound bow in which a large cam is not attached at an end portion of a limb has a smooth motion of a limb, which helps increase the speed of an arrow, and decrease the vibrations when shooting arrows.

The portability is enhanced as the size of the compound bow significantly decreases, and it is easy to shoot an arrow in a bush or something with a lot of obstacles.

BRIEF DESCRIPTION OF DRAWINGS

"A" of FIG. 1 is a view of an original compound bow, and "B" is a view of a compound bow which is most currently used, and "C" is a compound bow which is currently used and has a short distance between axles, and "D", "E" and "F" are views of perspective views of the present invention.

Limb (Li; Limb)
Cable guard (CG; Cable Guard)
Riser propria (RP, Riser Propria)
Riser extended (RE; Riser Extended)
Riser supportive (RS; Riser supportive)
Damper (Da; Damper)
Axle (Ax; Axle)
Connecting shaft (CS; Connecting Shaft)
Differential cam large lobe (DCLL; Differential Cam Large Lobe)
Differential cam small lobe (DCSL; Differential Cam Small Lobe)
String (St; String)
Intermediate string (IS; Intermediate String)
Limb string (LS; Limb String)
Buss cable 1 (BC1; Buss Cable1)
Buss cable 2 (BC2; Buss Cable2)
Fixing point (FP; Fixing Point)
Contact point (CP; Contact Point)
Y-pulley (YP; Y-Pulley)
Y-cam (YC; Y-Cam)
Y-cam large lobe (YCLL; Y-Cam Large Lobe)
Y-cam small lobe (YCLL; Y-Cam Small Lobe)
Lateral pulley (LP; Lateral Pulley)
Idler pulley (IP; Idler Pulley)
Synchronizing pulley (SP; Synchronizing Pulley)

BEST MODES FOR CARRYING OUT THE INVENTION

Figure 1:
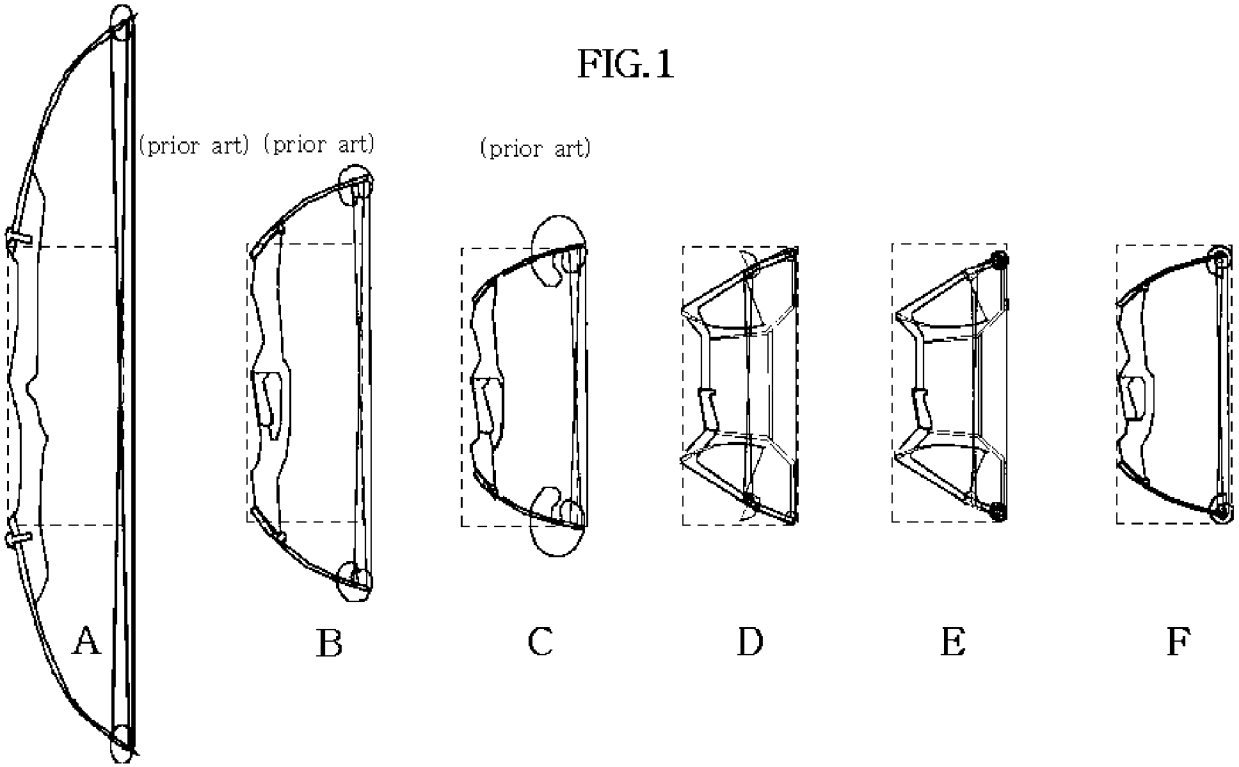
Figure 2:
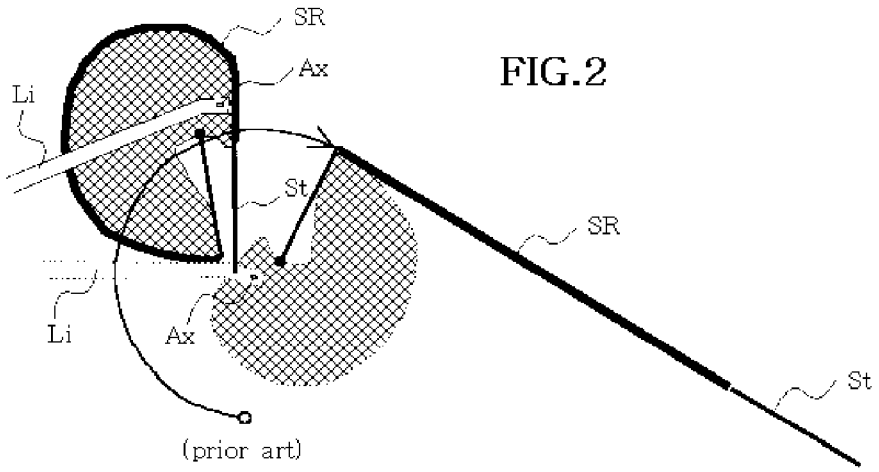
FIG. 2 is a perspective view illustrating a rotational amount of a cam and a string releasable (SR) in a conventional compound bow.
Figure 3:
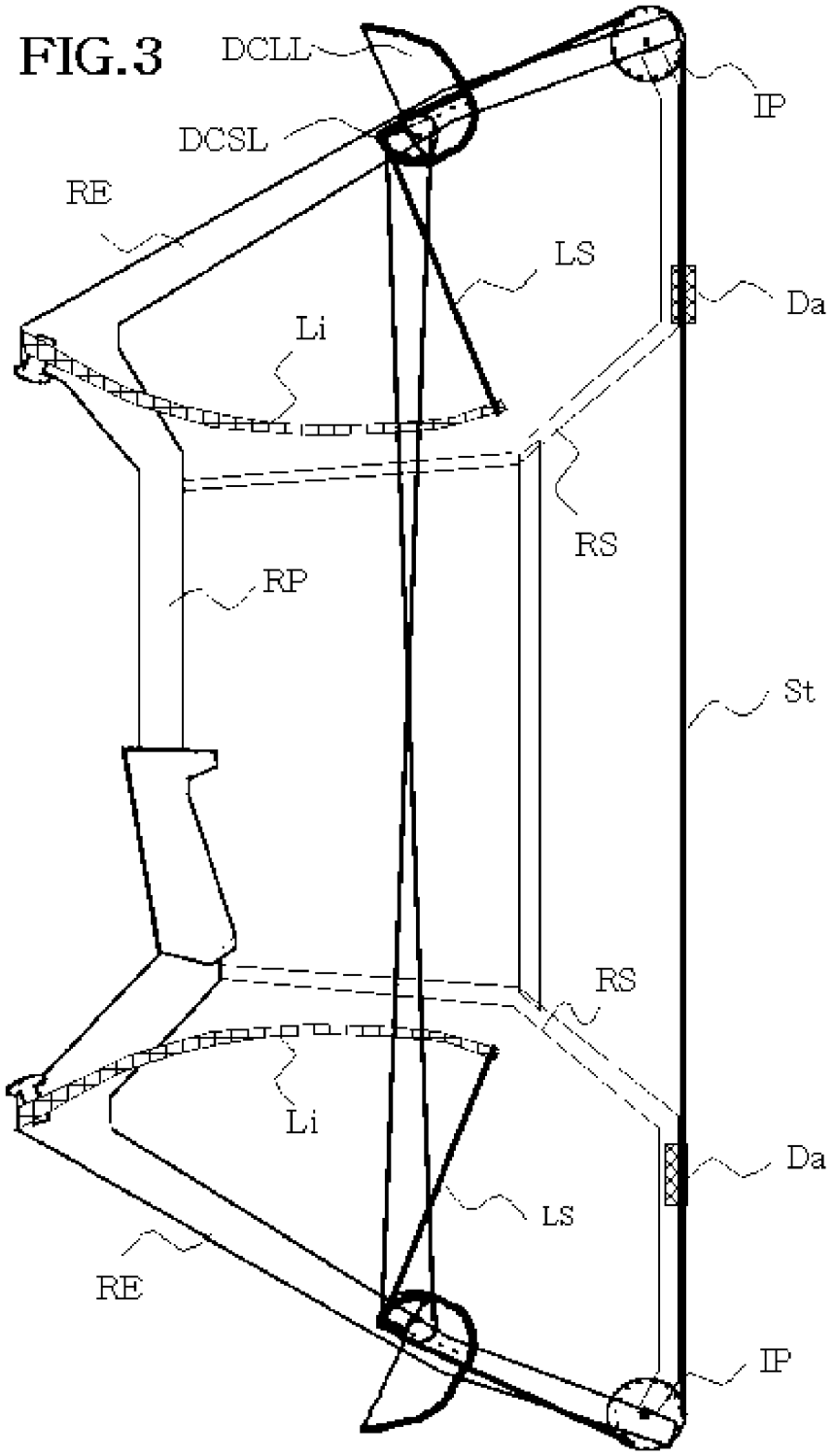
FIG. 3 is a view illustrating a compound bow which adapts a differential motion compound with a lot of rotational amount and an idler pulley according to the present invention.

First of all, the compound bow which adapts a differential motion cam with a lot of rotational amount as shown in FIG. 3 and an idler pulley (IP) will be described, and in the modes for carrying out the invention the compound bow of another embodiment and other elements will be described.

Figure 6:
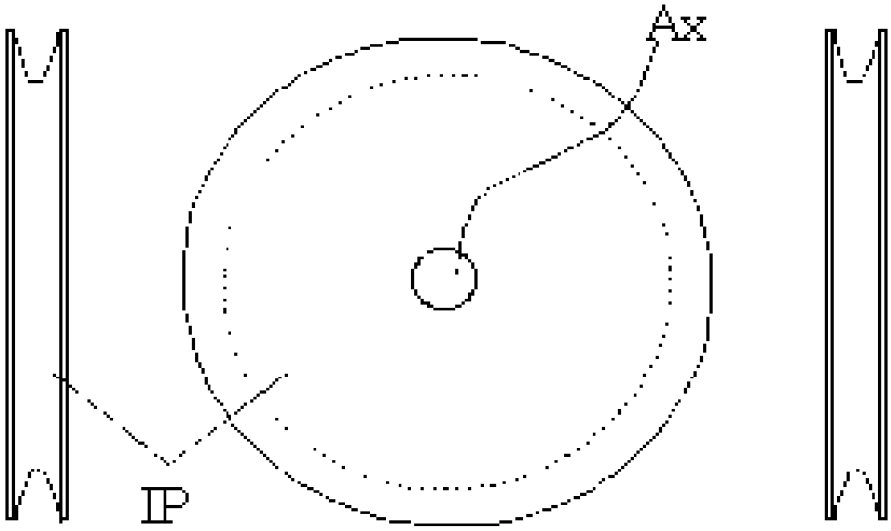
FIG. 6 is a view of an idler pulley adapted in a compound bow of FIG. 3.

The idler pulley (IP) provided at an end portion of the riser extended (RE) is manufactured in the manner as shown in FIG. 6. The groove is formed deep enough to prevent the string (St) from derailing, and it is formed not to be too large while caring not to damage it but the radius of it is not limited.

Figure 7:
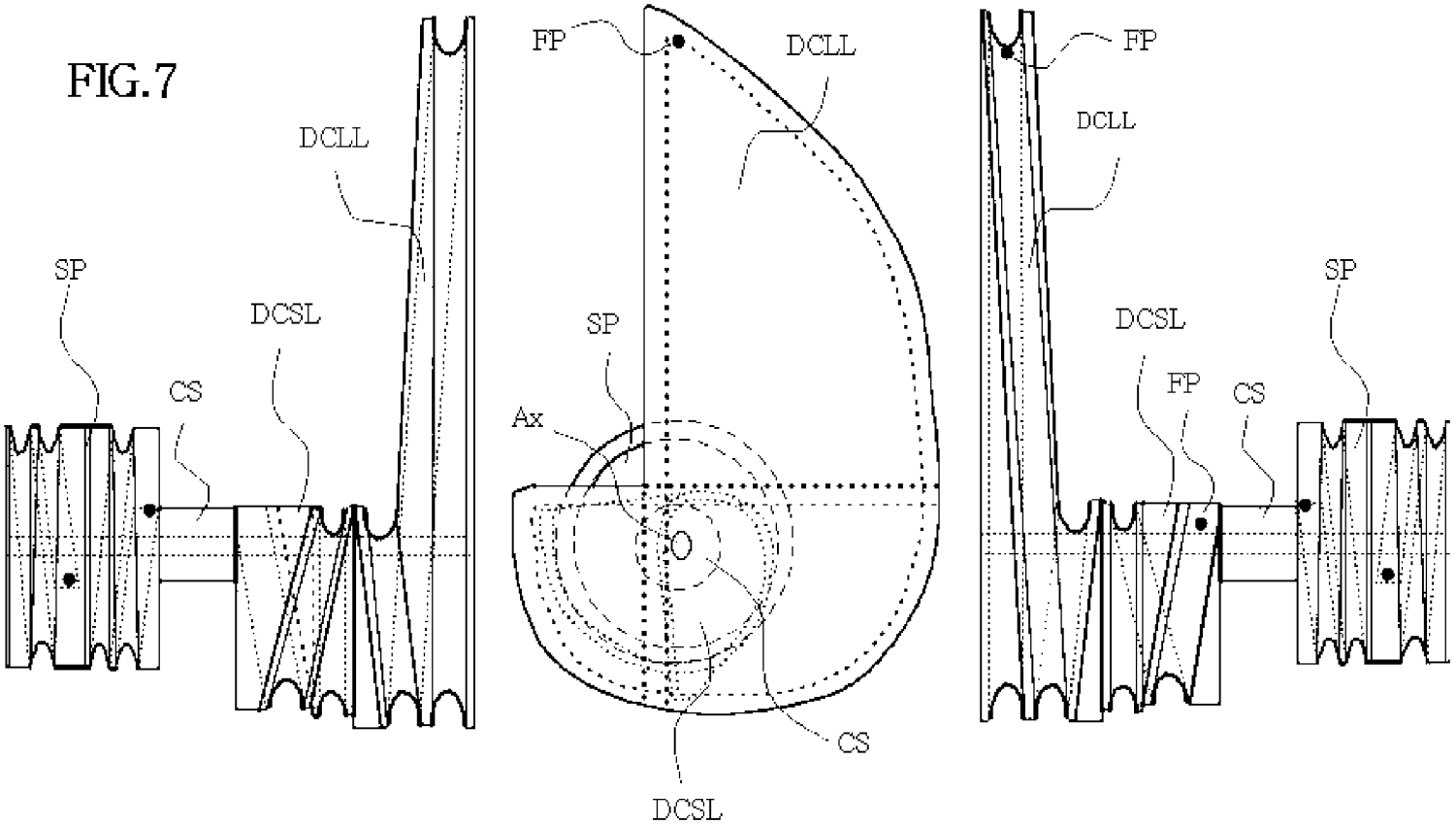
FIG. 7 is a perspective view when viewing from the side, front and back sides of a differential motion cam and a synchronizing pulley used in a compound bow of FIG. 3.

The differential cam large lobe (DOLL) rotating about 360°, the differential cam small lobe (DCSL), the connecting shaft (CS) and the synchronizing pulley (SP) are manufactured in the manner as shown in FIG. 7. As not shown in the drawings, part of the riser extended (RE) is manufactured in a detachable type, so it can be easily assembled to the riser extended (RE).

The size of the differential cam large lobe (DOLL) varies depending on the distance between axles of the desired draw length and the idler pulley (IP), and the characteristics of the energy storage and the let-off vary depending on the changes in the distance from the axle (Ax) to the groove. The size of the differential cam small lobe (DCSL) varies depending on the distance that the limb (Li) moves before and after the drawing. In addition, the characteristics of the energy storage and the let-off vary depending on the changes in the distance from the axle (Ax) to the groove.

As shown in FIG. 3, the riser propria (RP) and the riser extended (RE) are manufactured in an integrated form or a separated form.

As shown in FIG. 3, the limb (Li) is engaged to the riser, which engagement might be performed by making use of the limb pocket and the tension adjustment bolt like a conventional method.

Figure 24:
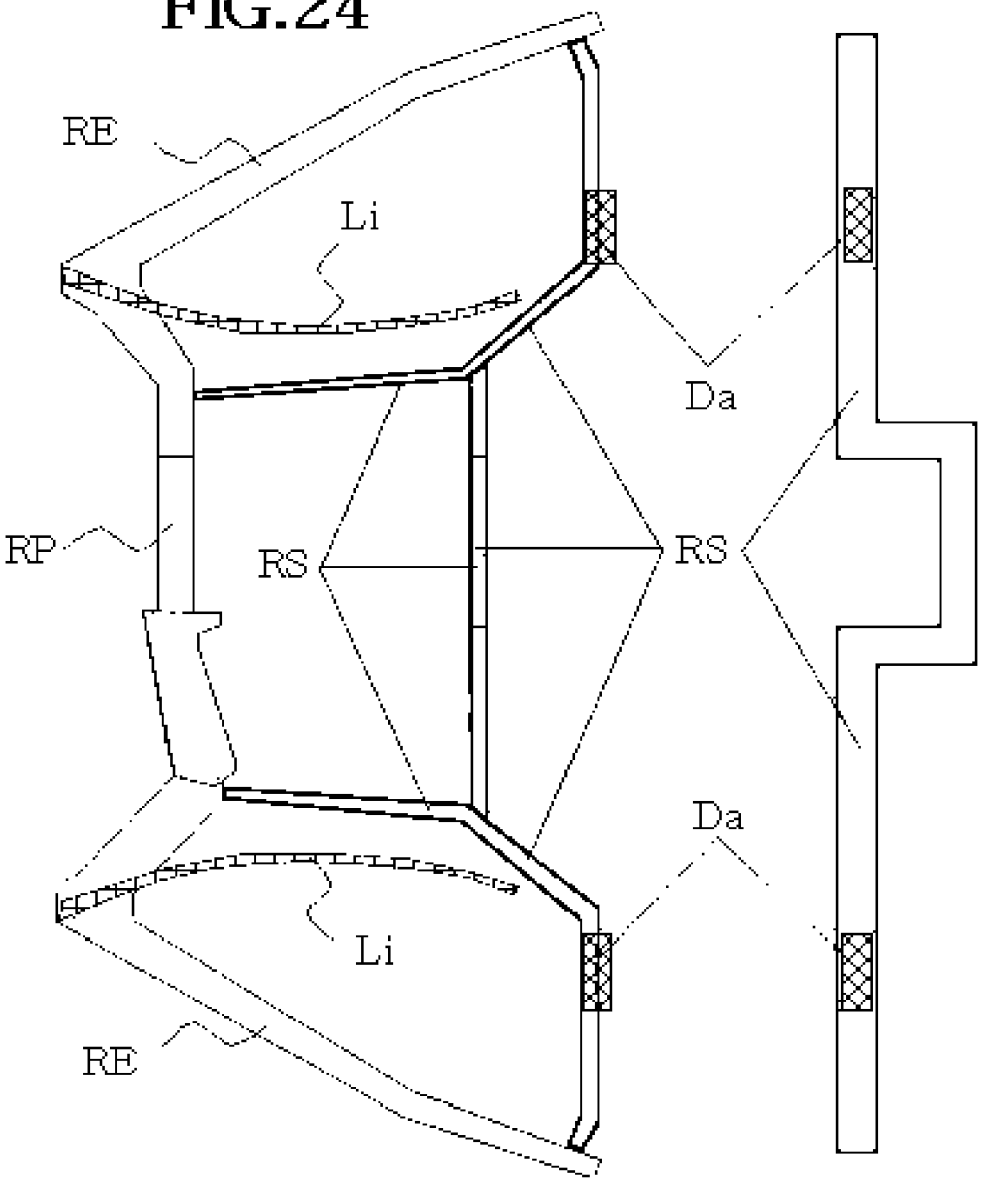
FIG. 24 is a perspective view of a riser supportive and a damper.

The riser supportive (RS) is manufactured and attached in the mechanical manner as shown in FIG. 24 to withstand the stresses with respect to the riser propria (RP) and the riser extended (RE). The bent section is included in the course of the manufacture so that the flying direction of the arrow is not interfered. An impact absorption member is attached so that part of the riser supportive (RS) plays a role of the damper which absorbs the vibrations from the string (St) after the arrow is shot.

The idler pulley (IP) is installed at an end portion of the riser extended (RE) as shown in FIG. 3.

One end of the string (St) passes through the idler pulley (IP) and through the straight line portion of the differential cam large lobe (DOLL) and passes through one round the differential cam large lobe (DOLL) and is fixed at the fixing point (FP) of the differential cam large lobe (DOLL) of FIG. 7.

The limb string (LS) is connected with a proper tensional force at the end portion of the limb (Li) and the fixing point (FP) of the differential cam small lobe (DCSL).

Figure 4B:
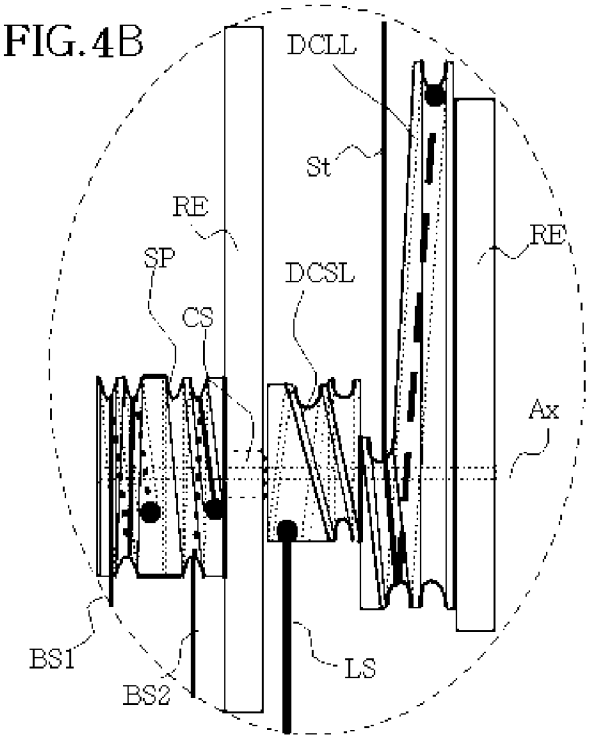
FIG. 4 is a side view and a rear view illustrating an interrelationship between a differential motion cam rotating at about 360° and used in a compound bow of FIG. 3 and a synchronizing pulley, a string, a riser extended and a buss cable.
Figure 4A:
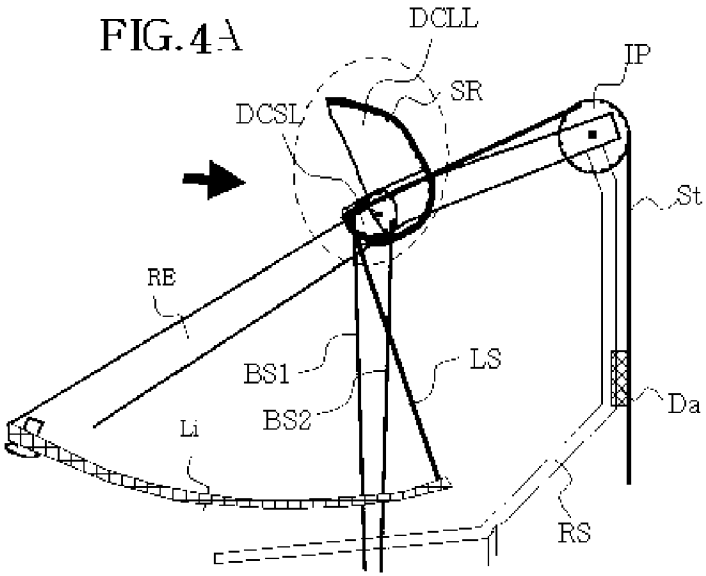
Figure 9A:
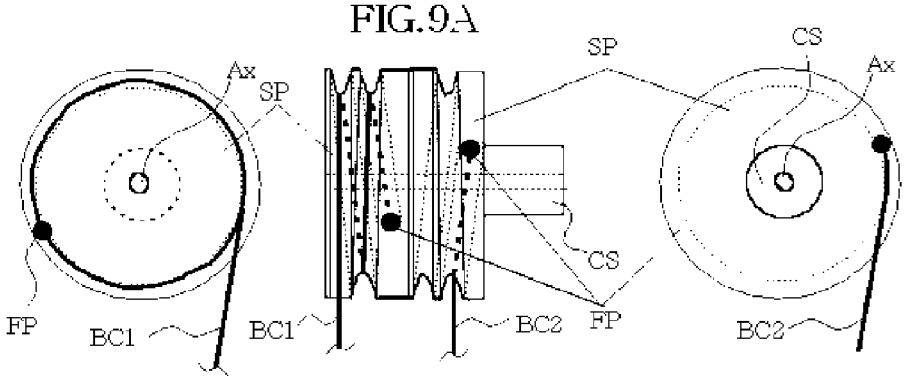
FIG. 9 is a perspective view of a synchronizing pulley.
Figure 9B:
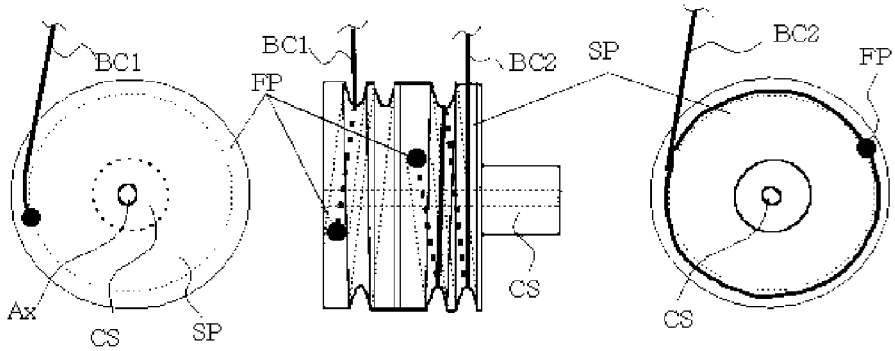

FIG. 9A shows a synchronizing pulley (SP) of an upper side of the compound bow in which when the buss cable 1 (BC1) is wound, the neighboring buss cable 2 (BC2) is released, and FIG. 9B shows the synchronizing pulley (SP) of the lower side in which when the buss cable 1 (BC1) of the upper side is wound, the buss cable 1 (BC1) of the lower side is released, so that they are synchronized. Since the synchronizing pulley of FIG. 9 can rotate about 540°, when there is a rotational amount below the angle, it might be used for synchronization, as a result of which no friction occurs between the buss cables. When more rotational amount is needed, it is needed to extend the groove of the pulley. FIG. 4B is a view when viewing from in the arrow direction of FIG. 4A. Since the synchronizing pulley (SP) is far out of the limb by a certain distance, the buss cable does not interfere with the flying of the arrow, so the cable guard is not needed.

Figure 5A:
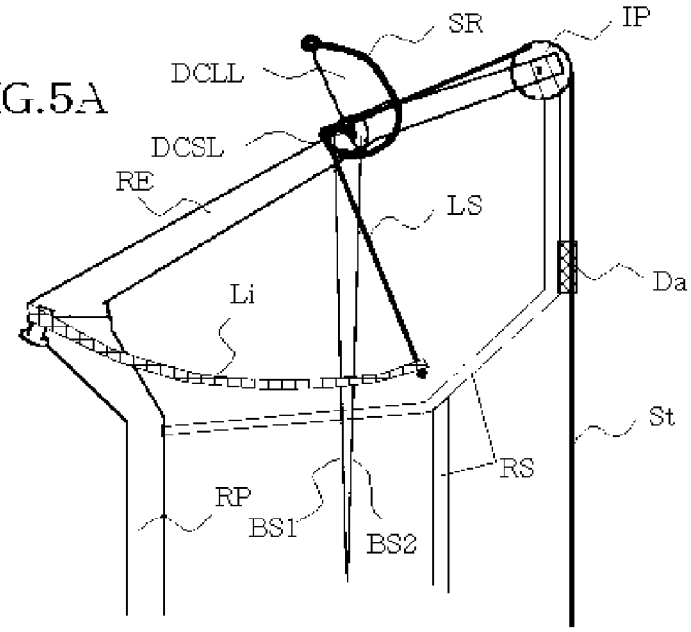
FIG. 5 is a side perspective view before and after a drawing in a compound bow of FIG. 3.

FIG. 5A shows the upper side of the compound bow which has been set up.

Figure 5B:
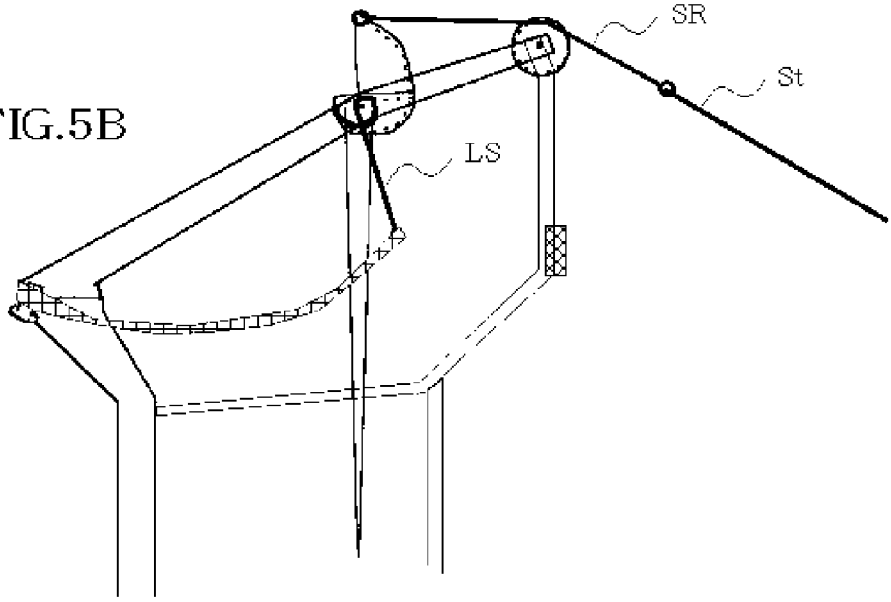

When the string (St) is drawn with one hand holding the grip and the other hand using a release, it becomes FIG. 5B. The idler pulley (IP) rotates a few turns in the clockwise direction. As it rotates 360° in the clockwise direction along with the differential cam large lobe (DOLL), the connection shaft (CS) and the synchronizing pulley (SP), the string (St), which was previously wound, is released.

The distance from the groove of the differential cam large lobe (DOLL) to the axle (Ax) is short at the initial stage of the drawing, and it becomes most distant when the drawing is finished, thus providing an energy storage characteristic of the compound bow.

The differential cam small lobe (DCSL) rotates in the clockwise direction and pulls the limb string (LS) and wounds on the differential cam small lobe (DCSL), so the limb (Li) comes to bend. When the drawing is finished, the limb string (LS) passes through the straight line section nearest from the axle (Ax) in the groove of the differential cam small lobe (DCSL), thus having a let-off characteristic. The draw weight is significantly decreased.

The compound bow, which has finished the drawing, proceeds to the calibration and shooting in accordance with the common methods.

MODES FOR CARRYING OUT THE INVENTION

Figure 8A:
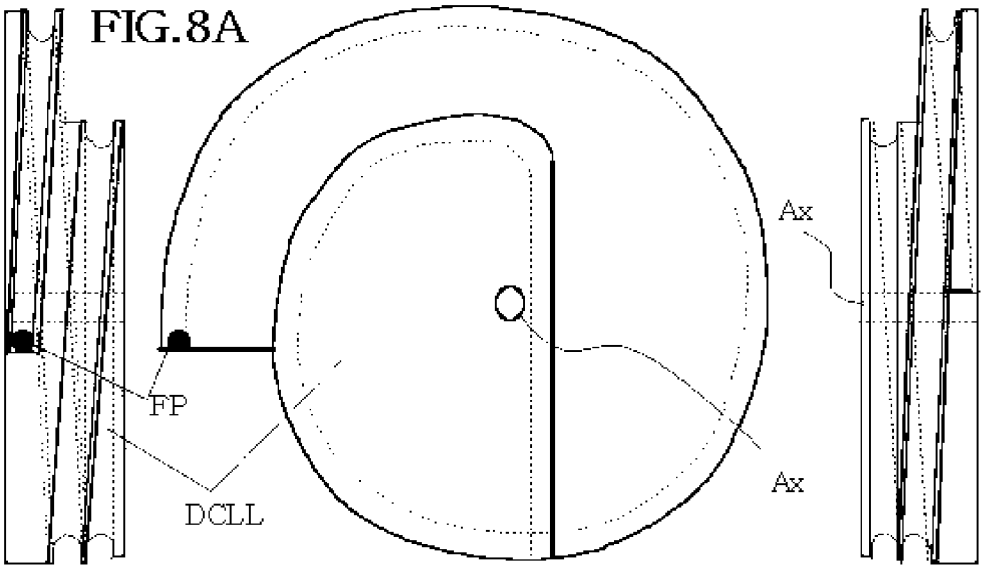
FIG. 8 is a perspective view when viewing from the side, front and back sides of a differential motion cam which can be used in a compound bow of FIG. 3 and can rotate 540° and a synchronizing pulley.
Figure 8B:
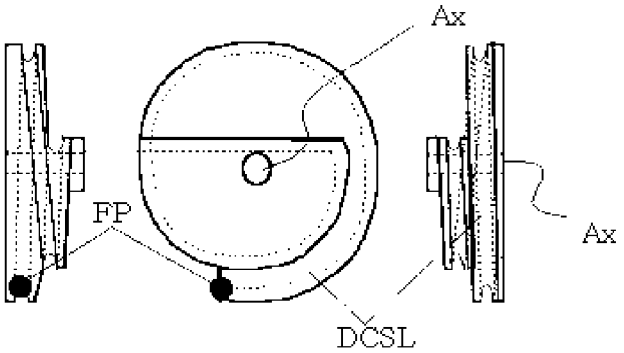
Figure 8C:
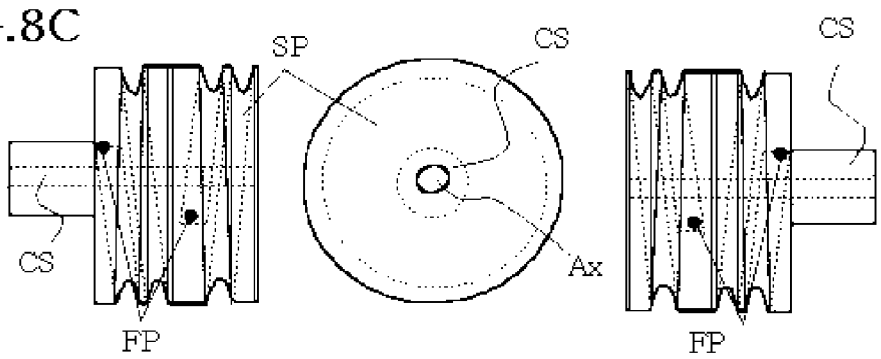
Figure 10A:
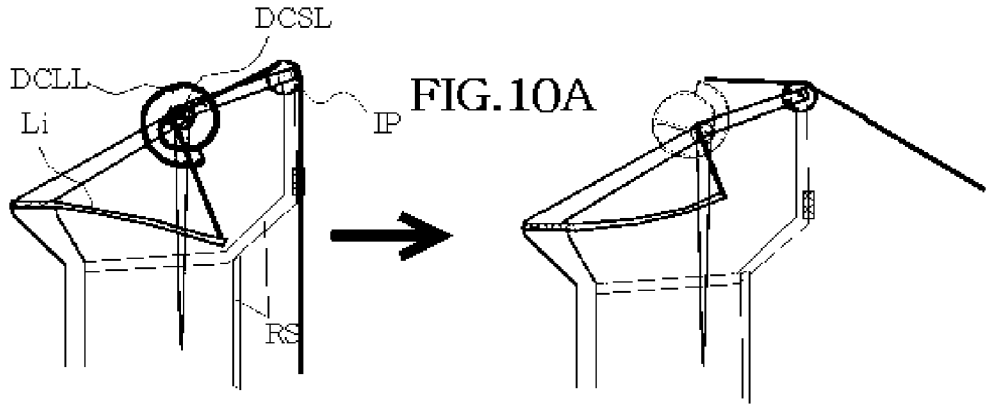
FIG. 10 is a view of various compound bows which adapt a differential motion cam with a lot of rotational amount and an idler pulley.
Figure 10B:
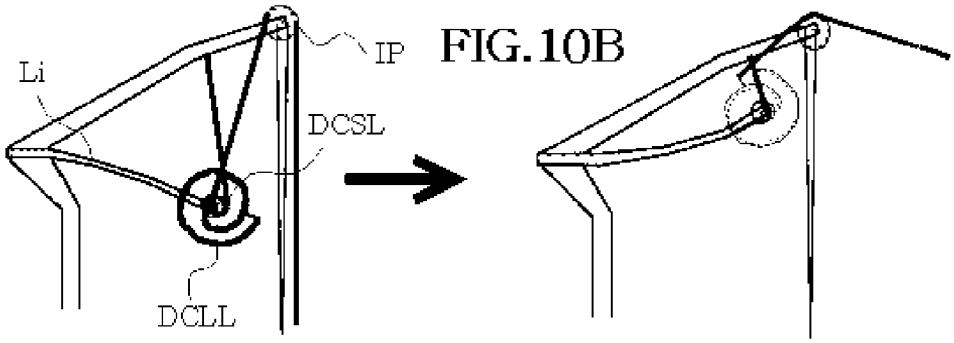

A few constructions might change from the compound bow of FIG. 3. Instead of using the differential cam which rotates 360° adapted in FIG. 7, the compound bow which rotates 540° as shown in FIG. 10A can be implemented by making use of the differential cam large lobe (DOLL) of FIG. 8A, the differential cam small lobe (DCSL) of FIG. 8B and the synchronizing pulley (SP) of FIG. 8C. The differential cam as shown in FIG. 10B might be provided at an end of the limb (Li), not at the riser extended (RE), and the limb (Li) might be positioned out of the riser extended (RE) as shown in FIG. 100. In addition, various shapes of compound bow might be constituted in combination with the Y-cam which appears later.

The compound bow shown in FIG. 3 and another embodiment of it were have been described so far.

Figure 11:
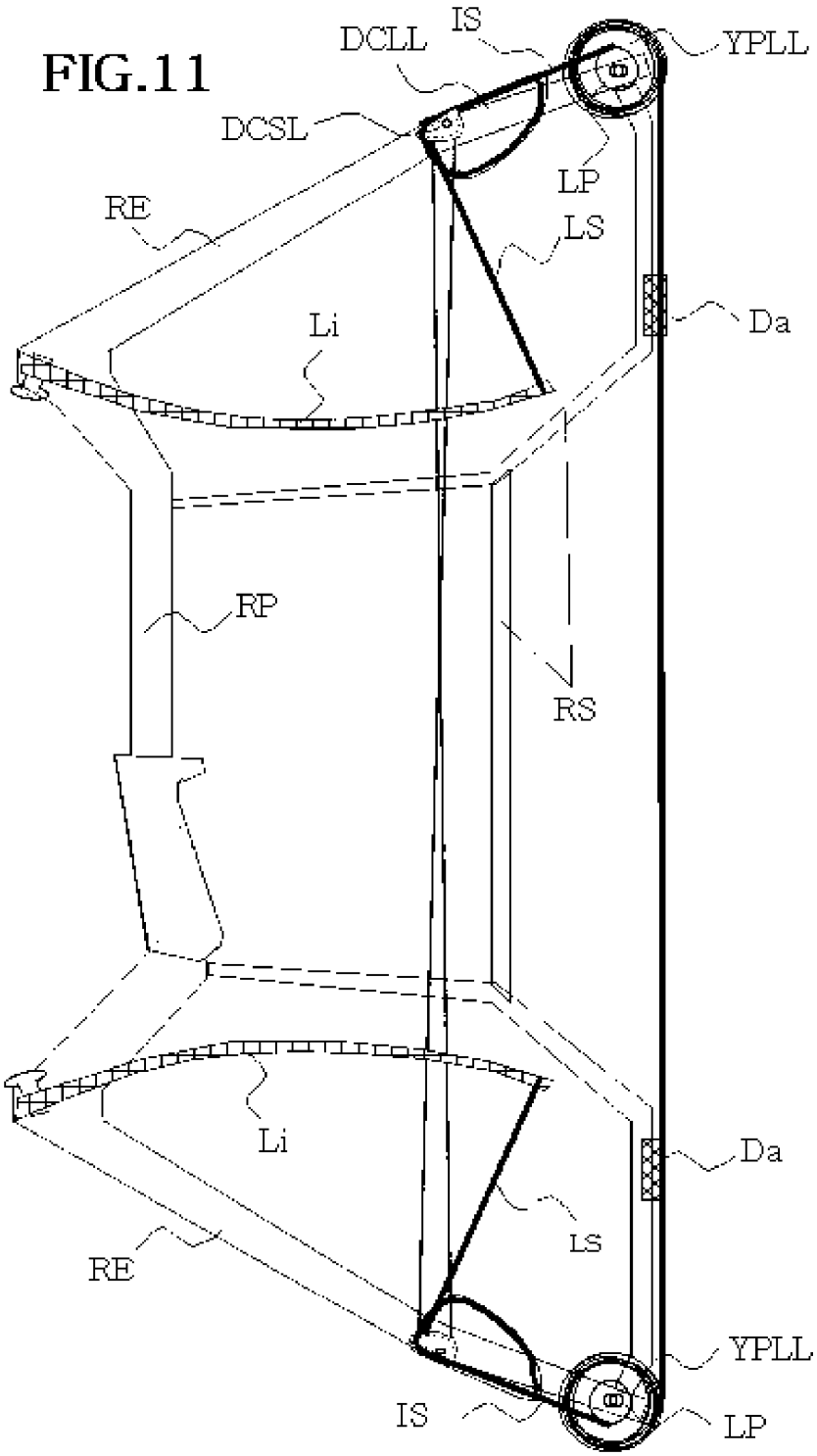
FIG. 11 is a view of a compound bow in which a differential motion cam with a rotational amount of about 270° and a Y-cam with a lot of rotational amount are together used according to the present invention.

FIG. 11 shows a compound bow which adapts a differential cam and the Y-cam with a lot of rotational amount.

The riser propria (RP), the riser extended (RE), the riser supportive (RS) and the limb (Li) are similar with the best modes for carrying out the invention.

Figure 13:
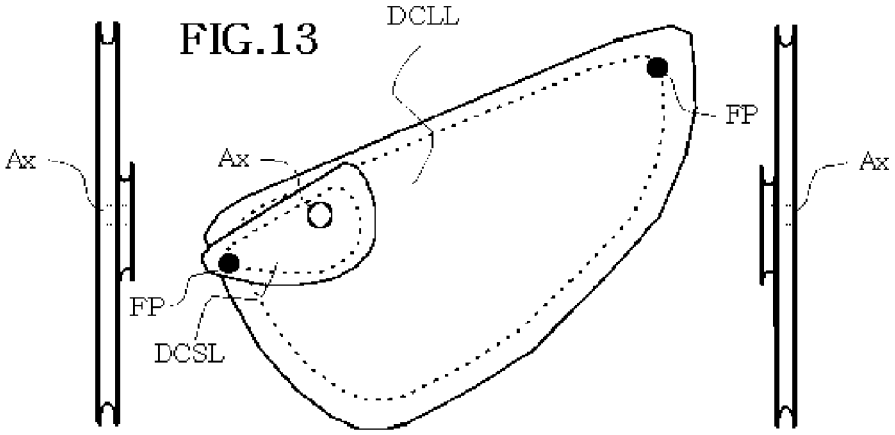
FIG. 13 is a view of a differential motion cam adapted in a compound bow of FIG. 11.

As shown in FIG. 13, the differential cam is manufactured to be a differential cam which rotates about 270°. The size of the differential cam small lobe (DCSL) varies depending on the distance that the limb (Li) moves before and after the drawing. The energy storage characteristic and the let-off vary depending on the changes in the distance from the axle (Ax) to the groove. The size of the differential cam large lobe (DOLL) varies depending on the rotational amount of the Y-pulley (YP), and the energy storage characteristic varies depending on the changes in the distance from the axle (Ax) to the groove.

Figure 14:
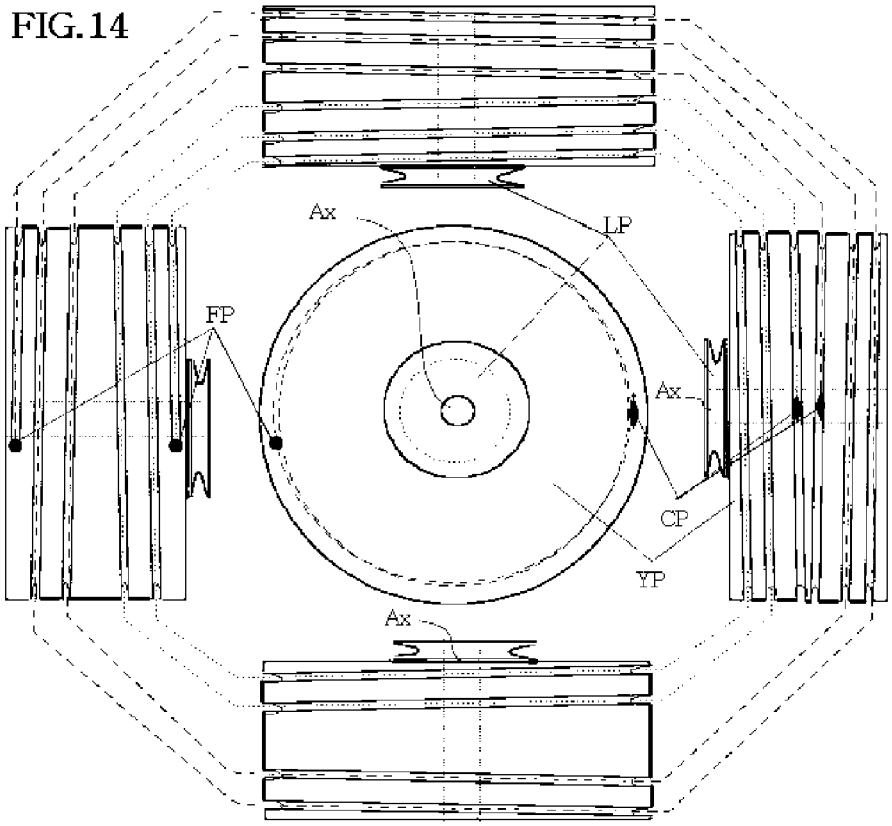
FIG. 14 is a view of a Y-pulley and a lateral pulley adapted in a compound bow of FIG. 11.

FIG. 9 shows the synchronizing pulley (SP) which rotates along with the differential cam. Since it can rotate up to 540°, it can be manufactured and used as shown in FIG. 9, and it might be manufactured to rotate slightly more of 270°. As shown in FIG. 4B, the synchronizing pulley (SP) is positioned on the plane different from the flying direction of the arrow. The Y-pulley (YP) to be installed at an end portion of the riser extended (RE) is manufactured in the manner as shown in FIG. 14. FIG. 14 is a perspective view that shows the Y-pulley (YP) with a groove accommodating the part of the Y-branch in the string (St) of the Y-shaped, when viewing the connection two divides of the string (St) corresponding to the Y-branch from the back, upper, front and bottom sides of it. Starting from two contact points (CP), it can rotate two turns and half, namely, it can rotate 900°, and since a slightly widened angle is always maintained, there is no any overlapping in the string (St). The revolutions, which can be actually used, varies depending on the radius of the draw length and the Y-pulley (YP), actually, a desired draw length can be obtained with one or two turns.

A lateral pulley (LP) is attached at the Y-pulley (YP). Since there is only one groove, when it rotates more than one turn, the intermediate string (IS) might be overlapped at the groove of the lateral pulley (IP). Since it does not matter in terms of the hitting ratio, the overlapping of the intermediate string (IS) seems to be allowable, but if it is concerned about the durability of the intermediate string (IS), it might be designed to rotate a few turns by making use of part of the synchronizing pulley (SP) of FIG. 9A in a state that the intermediate string (IS) is not overlapped. The radius of the lateral pulley (LP) is determined by means of the length of the intermediate string (IS) releasing from the intermediate differential cam and the rotational amount of the Y-pulley (YP).

When the riser propria (RP), the riser extended (RE), the riser supportive (RS) and the limb (Li) are ready, the differential motion cam and the Y-pulley (YP) are installed in the manner as shown in FIG. 11.

Figure 25A:
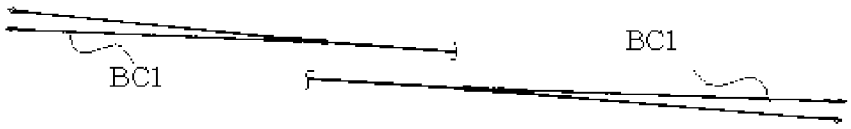
FIG. 25 is a perspective view of a buss cable and a string used in a Y-cam.
Figure 25B:
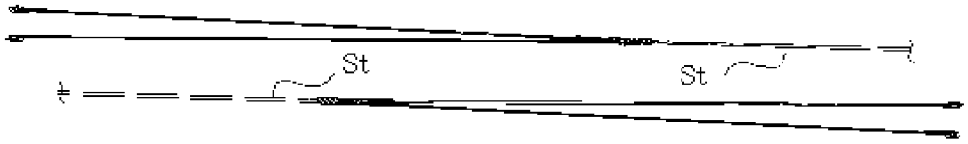
Figure 25C:
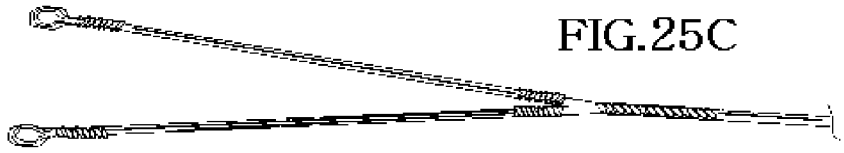

As shown in FIG. 25B, the string (St) is formed in a Y-shape as its both sides are distanced, the divided portion of which is enlarged and shown in FIG. 25C. When preparing the string (St), only the Y-branch of the upper and lower sides is MP/MY/10/0083 housed in the Y-pulley (YP), and it is previously divided from the Y-body. The string (St) is connected to the Y-cam fixing point (FP) and is wound two turns and half on the groove and is turned toward the opposite Y-cam and is wound two turns and half on the groove and remains symmetrical in its upper and lower sides while keeping a tensioned state when it is connected to the fixing point (FP).

Figure 12A:
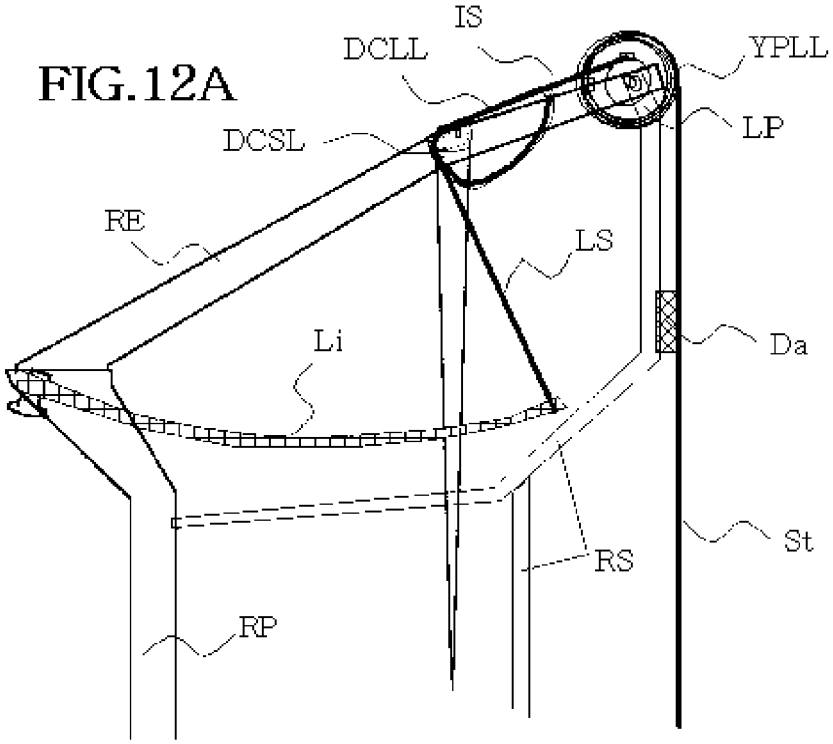
FIG. 12 is a perspective view before and after a drawing of a compound bow of FIG. 11.

As shown in FIG. 12A, the intermediate string (IS) is connected with one end being fixed at the lateral pulley (LP) attached to the Y-pulley and the other end passing through the straight line section of the differential cam large lobe (DOLL) and through the section where the radius gradually increases and being finally fixed at the portion where the radius is farthest.

As shown in FIG. 12A, the limb string (LS) is connected to the fixing point (FP) which is positioned at the portion where the radius of the differential cam small lobe (DCSL) is longest. The opposite end portion of the limb string (LS) is connected to the limb (Li) with a proper tensional force. If the intermediate string (IS) and the limb string (LS) are meant to pass through the interior of the differential cam, one connected string is enough.

When the synchronizing pulley (SP) is positioned in the manner as shown in FIG. 4, the buss cable does not interfere with the flying direction of the arrow. As shown in FIG. 9, the buss cable is connected in such a way that the differential cam is synchronized.

When the setting is finished, the upper side of the compound bow becomes a state as shown in FIG. 12A.

Figure 12B:
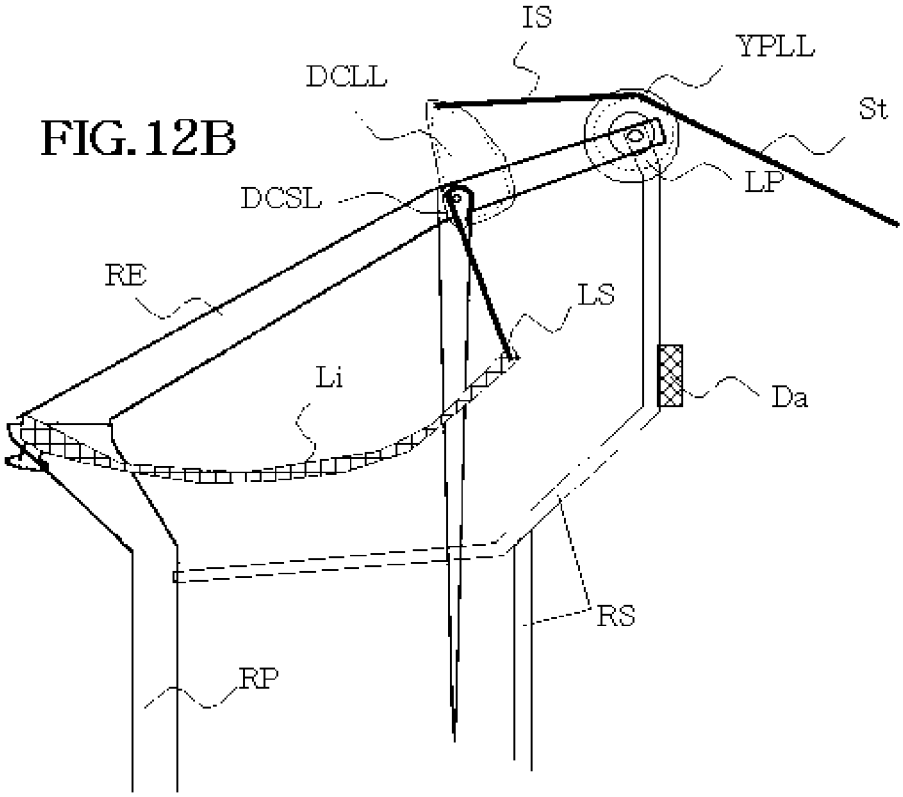

When the string (St) is drawn using the release, it becomes FIG. 12B. As the string (St) wound on the pulley (YP) is released, the lateral pulley (LP) rotates in the clockwise direction, and the differential cam large lobe (DOLL) rotates in the clockwise direction, and the intermediate string (IS) is released and wound on the lateral pulley (LP). Here, the differential cam large lobe (DOLL) and the fixed differential cam small lobe (DCSL) rotate in the clockwise direction. Since the limb string (LS) is connected at the fixing point (FP), the limb string (LS) is wound on the differential cam small lobe (DCSL), and the limb (Li) is bent. When the differential motion cam rotates 270°, the intermediate string (IS) of the differential cam large lobe (DOLL) is all released, and the intermediate string (IS) is positioned farthest from the differential cam axle (Ax), and the limb string (LS) wound on the differential cam small lobe (DCSL) is positioned shortest from the differential cam small lobe (DCSL) and the axle (Ax), so it can have a let-off characteristic, and the draw weight is significantly reduced.

When an arrow is drawn and shot, the limb (Li) is expanded, and the wound limb string (LS) is pulled, and the differential cam small lobe (DCSL) and the differential cam large lobe (DOLL) rotate in the counterclockwise direction.

The intermediate string (IS) is wound on the differential cam large love (DOLL) and the intermediate string (IS) is pulled, and as the lateral pulley (LP) rotates in the counterclockwise direction, the wound intermediate string (IS) is unwound.

At the same time, as the Y-pulley (YP) rotates in the counterclockwise direction, the string (St) is pulled, and the arrow is shot.

Figure 15:
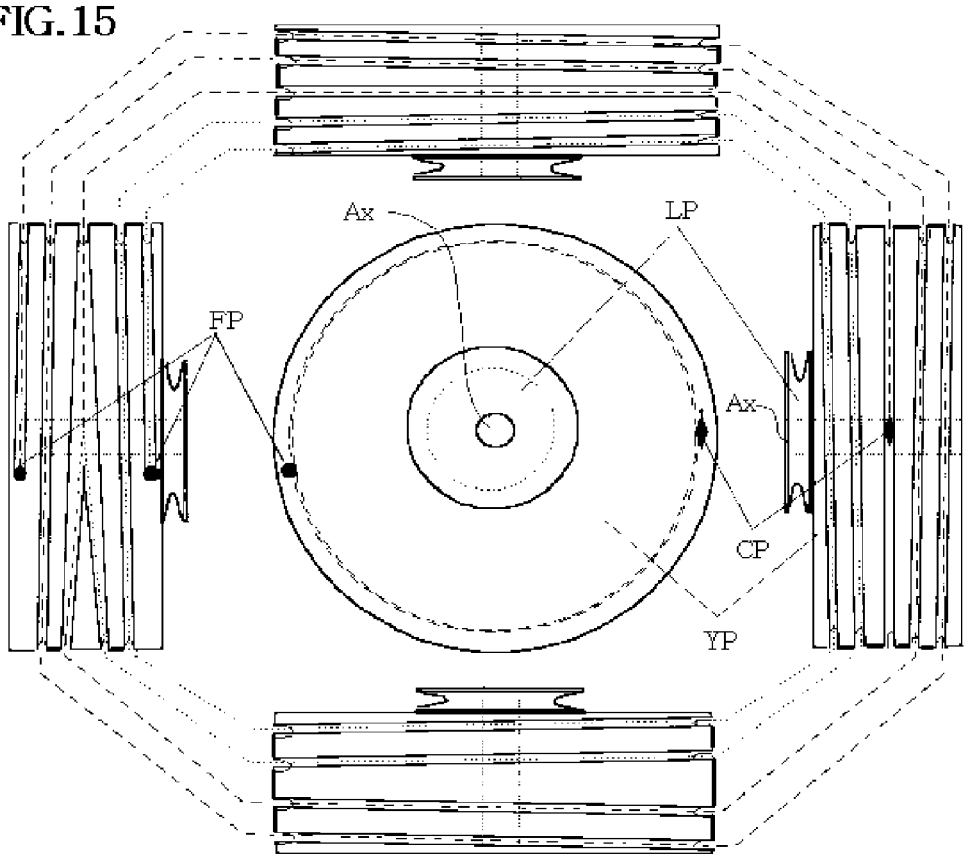
FIG. 15 is a view of a Y-pulley of another type and a lateral pulley adapted in a compound bow of FIG. 11.

FIG. 11 shows another embodiment of the compound bow. The limb (Li) should be arranged outside the riser extended (RE), and the Y-pulley (YP) of FIG. 15 might be used instead of using the Y-cam of FIG. 14. The Y-cam of FIG. 15 can house even the string (St) corresponding to the Y-body including the Y-branch.

Figure 16:
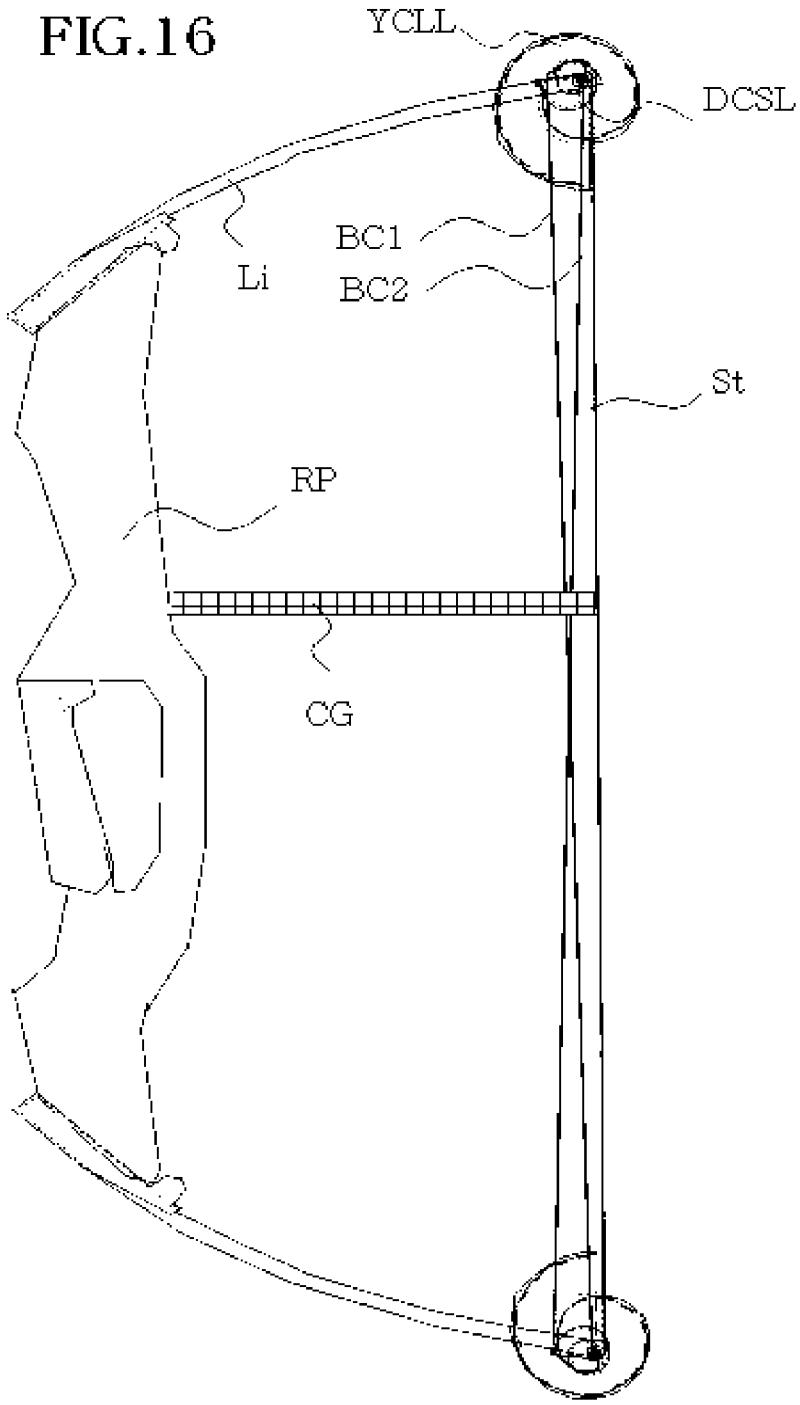
FIG. 16 is a view of a compound bow used in combination with a Y-cam with a lot of rotational amount according to the present invention.

FIG. 16 is a view illustrating a compound bow adapted in combination with a Y-cam with a lot of rotational amount.

Figure 17A:
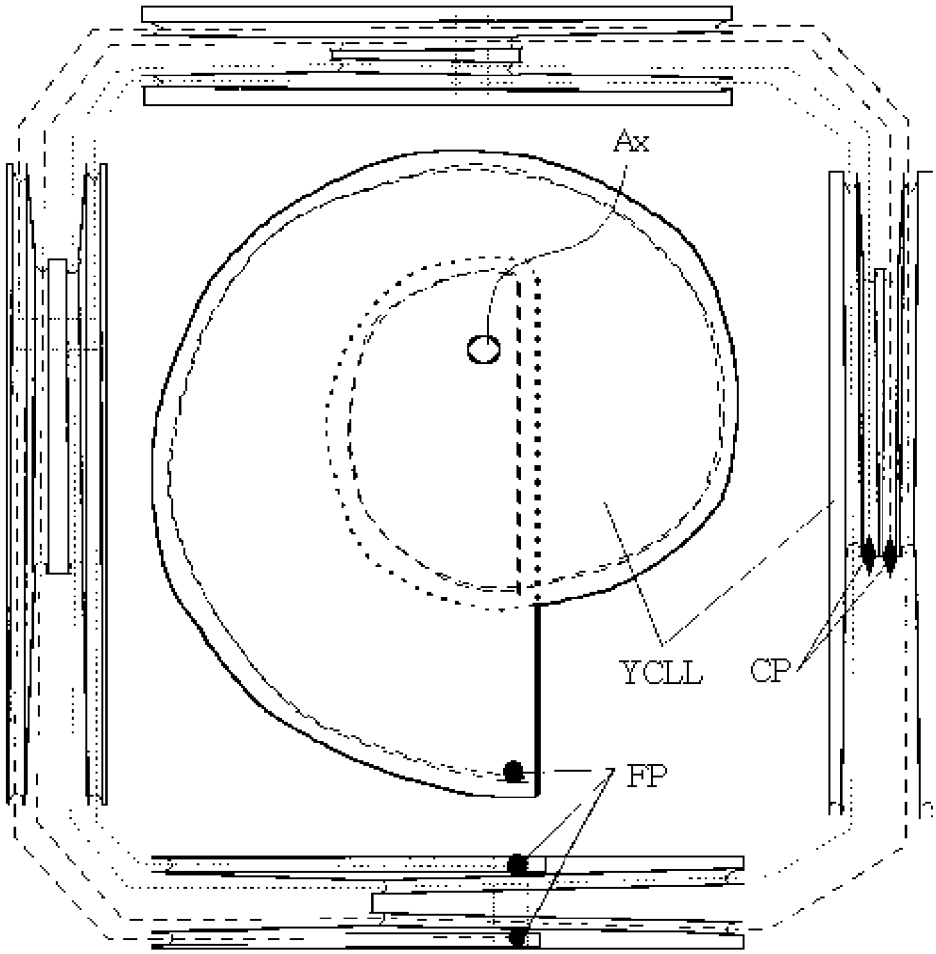
FIG. 17 is a view of a Y-cam and a differential cam small lobe adapted in a compound bow of FIG. 16.
Figure 17B:
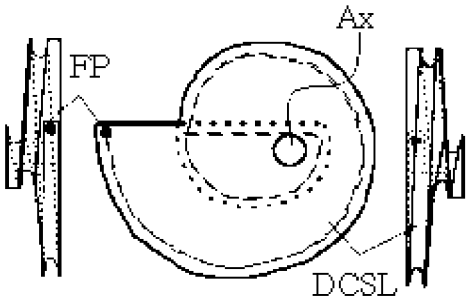

As for the cam, the Y-cam large lobe (YCLL) of FIG. 17A and the differential cam small lobe (DCSL) of FIG. 17B are used, and the cam is designed to rotate 650°.

Figure 18:
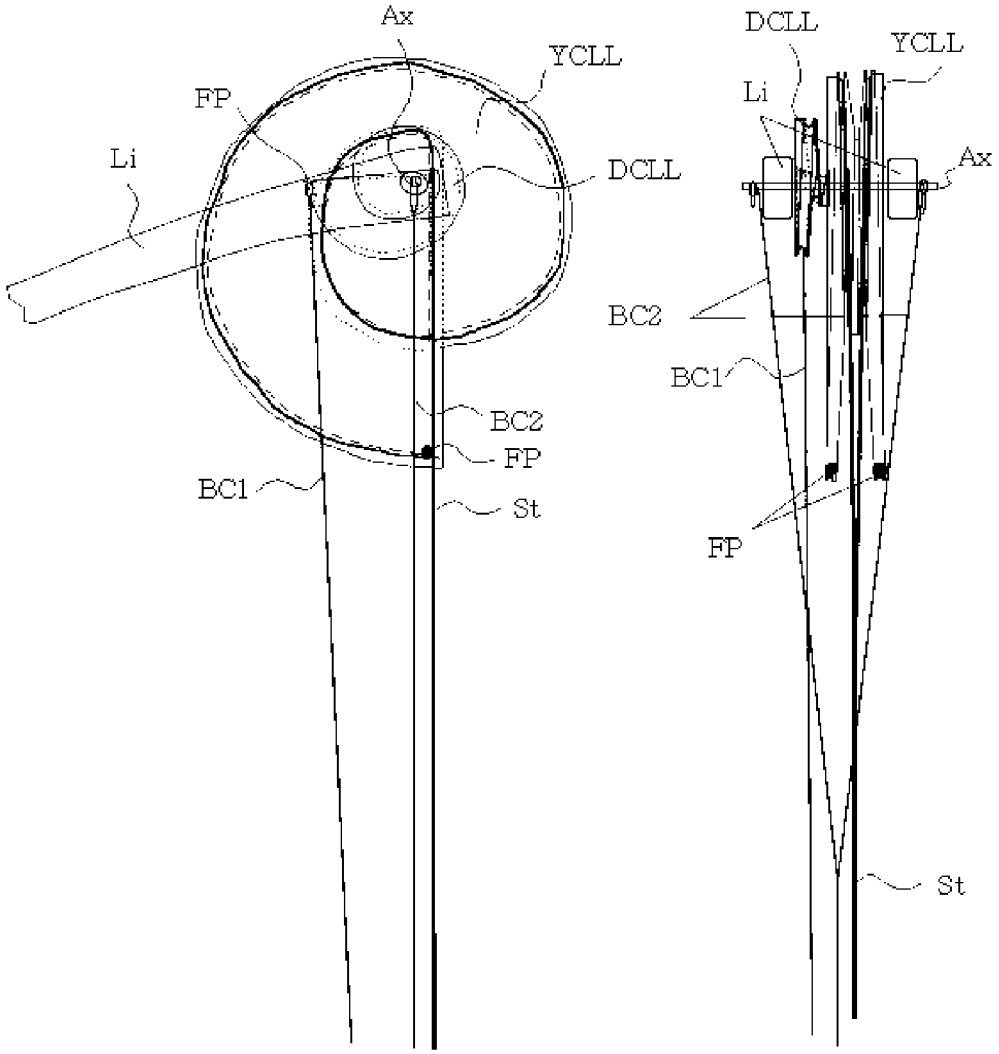
FIG. 18 is a perspective view before a drawing of a compound bow of FIG. 16.

FIG. 18 is a side and backside view before drawing. As shown in FIG. 25B, the string (St) is Y-shaped as its both sides are divided, the divided portion of which is enlarged and shown in FIG. 25C. When preparing the string (St), it is previously divided from the Y-body so that only the Y-branch of upper and lower sides is housed in the Y-pulley (YP). It comes into contact with the straight line section of the Y-cam large lobe (YCLL) and goes up and rotates 650° in the counterclockwise direction, and passes through the groove with a long radius and is fixed at the portion where its radius is longest. When viewing from its backside, the string (St) of the divided Y-shape does not overlap, and occupies its own groove. The buss cable 1 (BS1(BC1)) is fixed at a portion where the radius of the differential cam small lobe (DCSL) is longest, and the opposite side of it is fixed at the limb (Li) of the lower side. The buss cable 2 (BS) is fixed at a portion where the radius of the differential cam small lobe (DSL (DCSL)) is longest, and the opposite side is fixed at the limb (Li) of the upper side.

Figure 19:
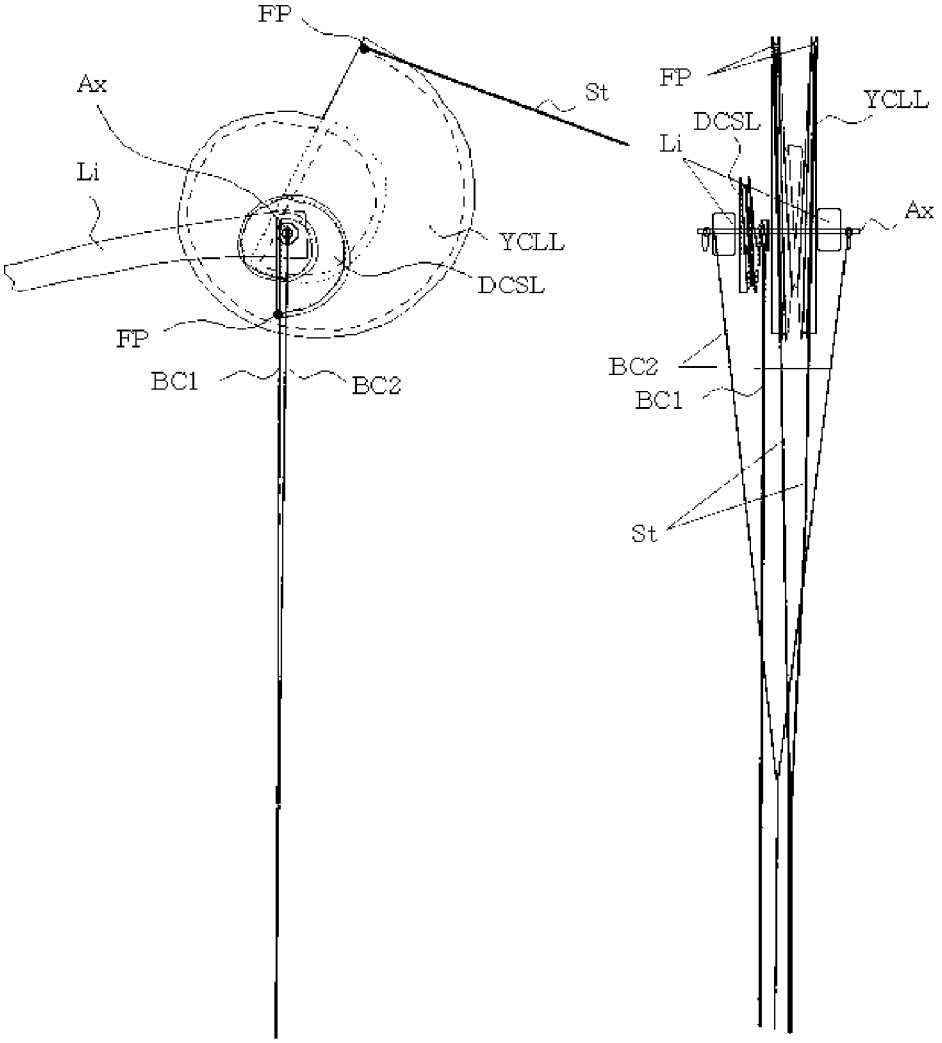
FIG. 19 is a perspective view after a drawing of a compound bow of FIG. 16.

FIG. 19 is a lateral and backside view after the drawing. The string (St) wound on the Y-cam large lobe (YCLL) is released, and the Y-cam large lobe (YCLL) rotates about 650°, and the end portion of the string (St) of the Y-branch shape pulls the portion where the radius of the Y-cam large lobe (YCLL) is longest. When viewing from its backside, the string (St) of the Y-shape is released, and no overlapping exists. The buss cable 1 (BS1(BC1)) passes through the straight line section of the differential cam small lobe (DCSL) and is wound 650°, and pulls the portion where the radius of the differential cam small lobe (DCSL) is smallest.

The string (St) and the buss cable are all affected by the cam, it is easy to obtain a desired characteristic of the compound bow.

Figure 20A:
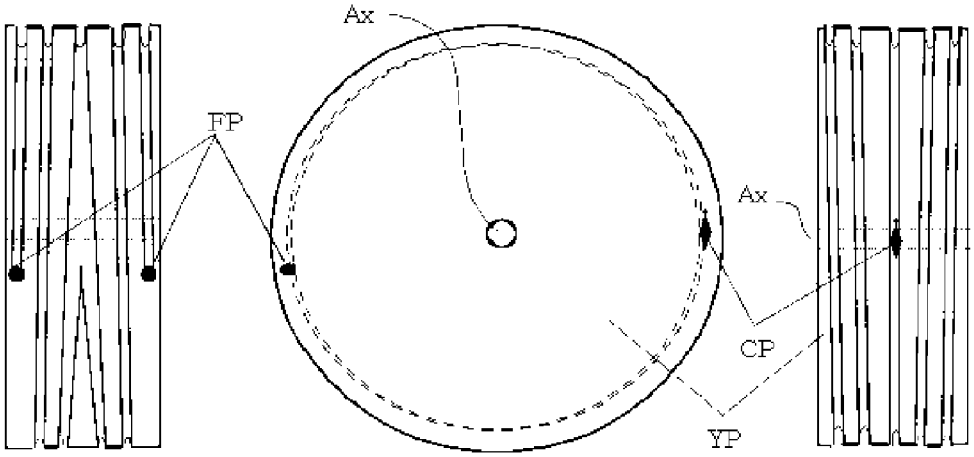
FIG. 20 is a view of a Y-pulley and a Y-cam small lobe adapted in a compound bow of FIG. 16.
Figure 20B:
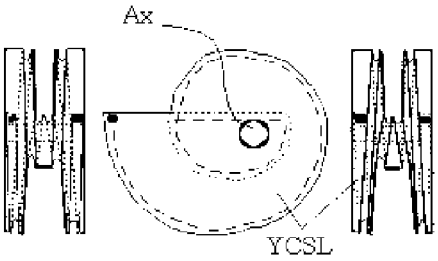
Figure 21:
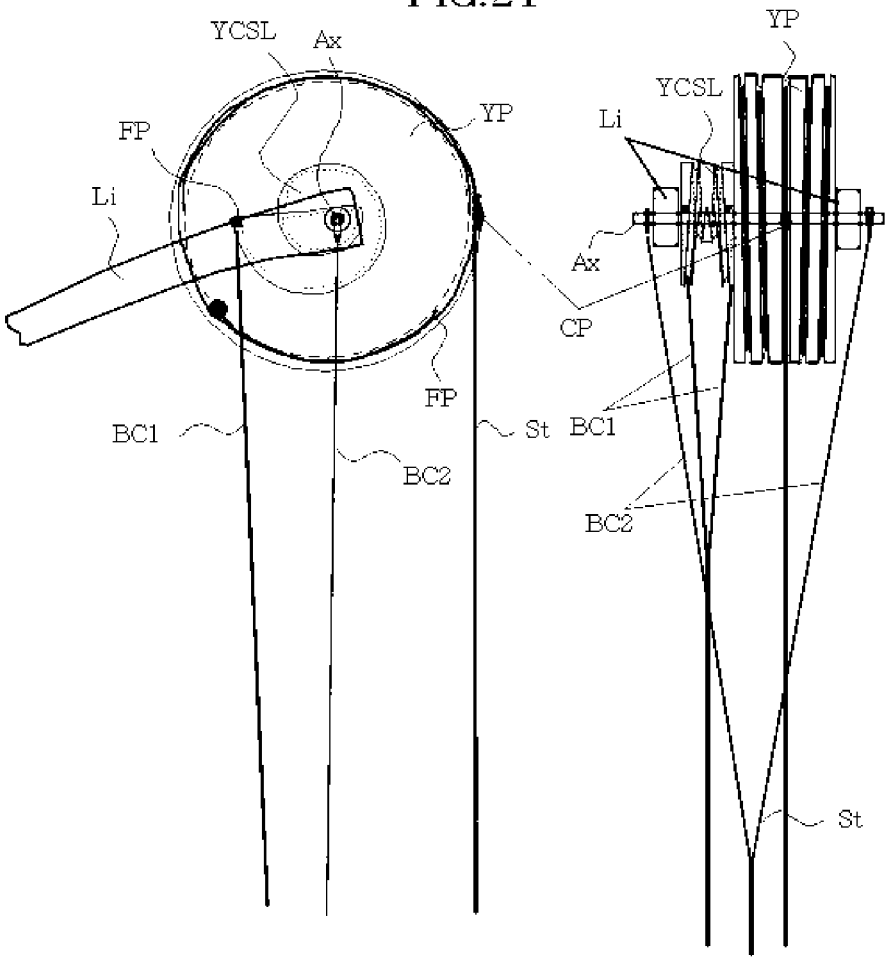
FIG. 21 is a perspective view before a drawing of a compound bow which is equipped with a Y-pulley and a Y-cam small lobe of FIG. 20 in a compound bow of FIG. 16.

The compound bow of FIG. 16 can be constituted using the Y-pulley (YP) of FIG. 20A and the Y-cam small lobe (YCLL) of FIG. 20B. The string (St) as shown in FIG. 25B is used. The thusly constituted compound bow has a construction before the drawing as shown in FIG. 21. Since the groove as shown in FIG. 20A is formed, the string (St) corresponding to the Y-body rotates about 180° along the groove, starting from the contact point (CP), and is divided and continuously passes through each groove and is wound 900° on the Y-pulley and is finally fixed. When it is actually used, since the rotation of the Y-cam small lobe (YCLL) terminates at an angle of 650°, the Y-pulley (YP) rotates only 650°, and the surplus string (St) remains wound, not be released.

The buss cable as shown in FIG. 25A is used. The buss cable 1 (BS1(BC1)) divided in a Y-shape as shown in FIG. 21 is respectively fixed at the portion where the radius of the Y-cam small lobe (YCSL) is longest.

Figure 22:
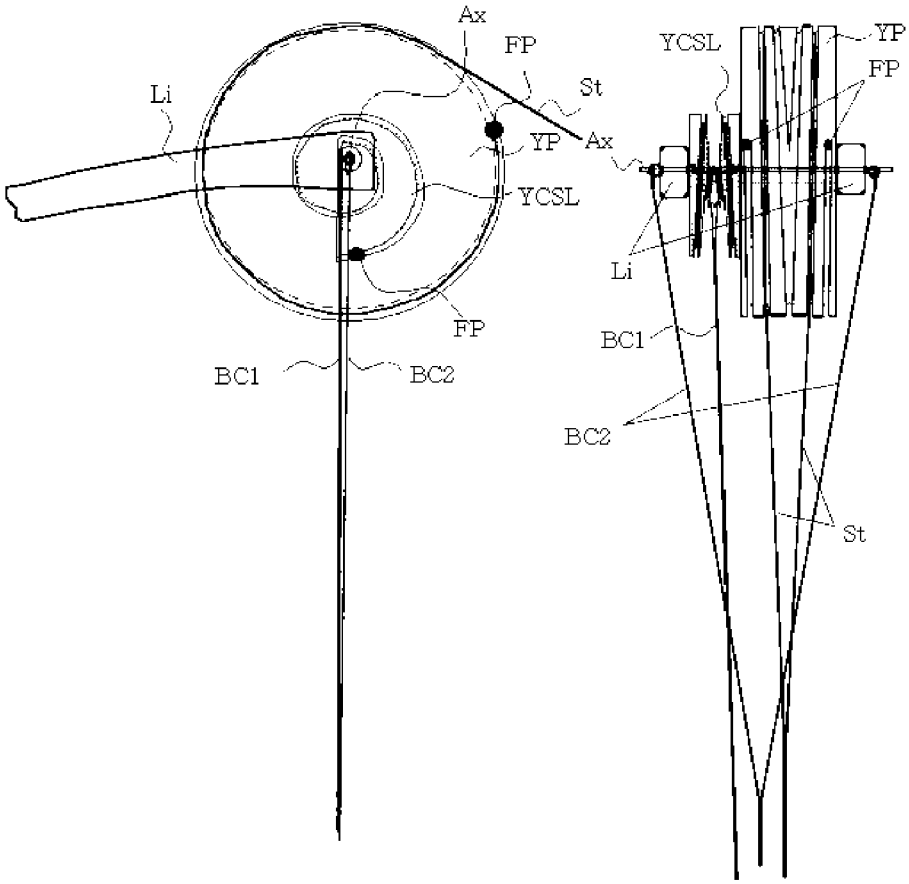
FIG. 22 is a perspective view after a drawing of a compound bow which is equipped with a Y-pulley and a Y-cam small lobe of FIG. 20 in a compound bow of FIG. 16.

FIG. 22 is a view after the drawing. The string (St) of a Y-shape is released as much as 650°, and the string is still wound as much as 250°, and the buss cable 1 (BS1(BC1)) divided in a Y-shape occupies each groove without being overlapped, and is wound as much as 650°. The Y-shaped pulley (YP) has a function of providing the length of the string (St) and does not affect the energy storage characteristic and the let-off; however it has come to have an energy storage characteristic and a let-off characteristic owing to the Y-cam small lobe (YCLL). It is possible to combine after the rotational amount of the Y-cam small lobe (YCLL) is extended up to 900°.

Figure 23A:
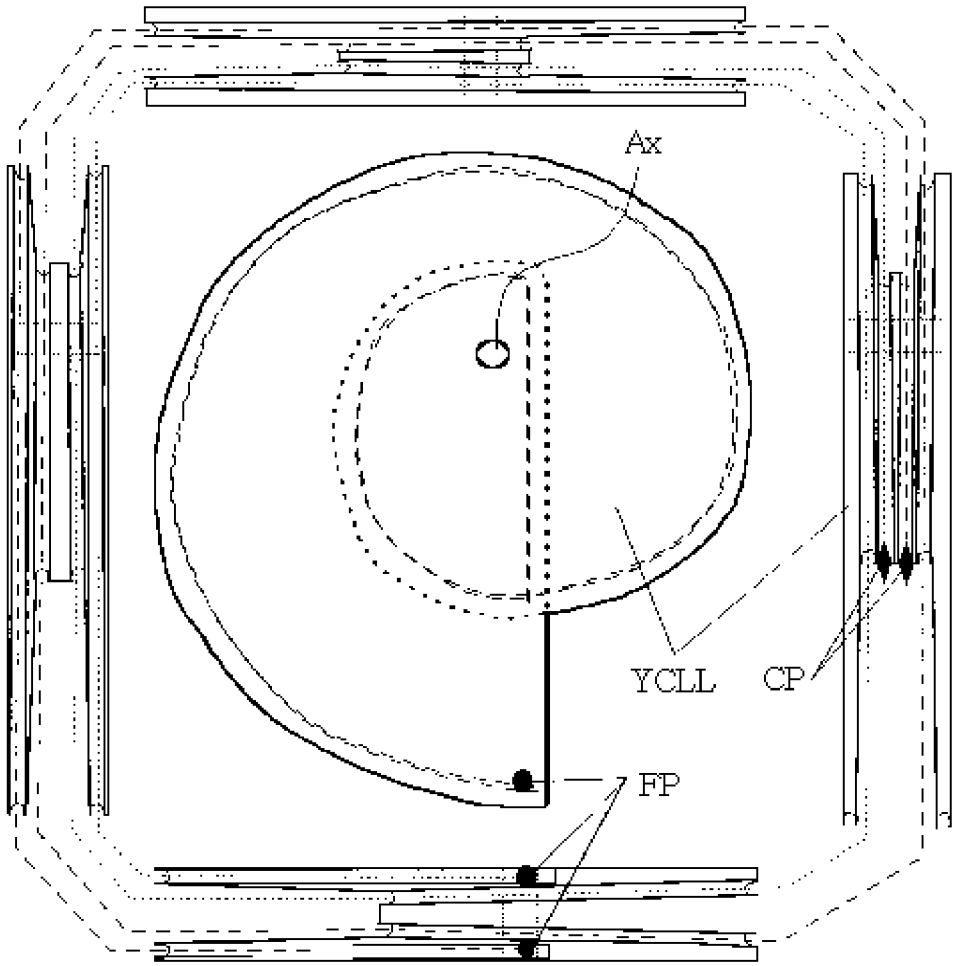
FIG. 23 is a view of two cams that a Y-cam large lobe of FIG. 17A and a Y-cam small lobe of FIG. 20B which can be adapted in a compound bow of FIG. 15 are symmetrically divided into two parts.
Figure 23B:
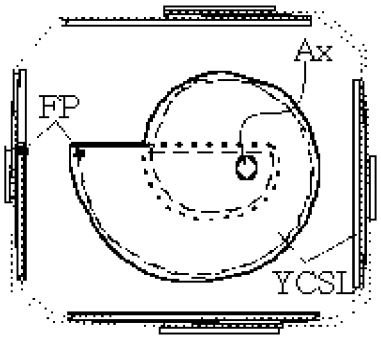
Figure 23C:
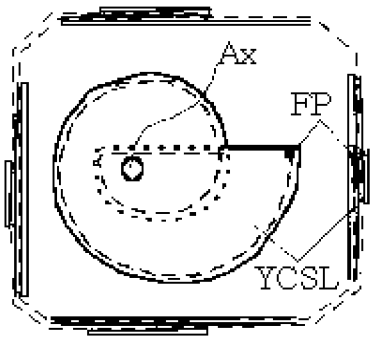

FIG. 23A shows a Y-cam which can rotate 650°. As shown therein, the passage of the string (St) corresponding to the Y-shaped branch is indicated as two kinds of dotted lines from the contact point (CP) to the fixing point (FP). FIG. 23B shows a construction that the Y-cam small lobe (YCSL) of FIG. 20B is symmetrically divided into two parts. The Y-cam can be constituted by attaching the thusly divided Y-cam small lobe (YCSL) to both sides of the construction as shown in FIG. 23A. At this time, the arrow flies toward the plane defined by the string (St) and the buss cable, so a cable guard is needed. It is preferred to use a method disclosed in "Cable guard eliminator US2009/0165766 A1 John D. Evans Jul. 2, 2009". The two-divided Y-cam small lobe (YCLL) might be used in combination with the Y-pulley (YP) and can be used in the compound bows as shown in FIGS. 3, 10A, 10B and 10C.

In order to use the Y-pulley (YP) or the Y-cam, a Y-shaped string (St) or the buss cable is needed as shown in FIG. 30, and it is easy to prepare because it is widely used with different lengths.

In the present invention, the riser supportive (RS) is adapted so as to support the riser propria (RP) and the riser extended (RE). FIG. 24 shows an example of the riser supportive (RS) and the damper (Da). Since the riser propria (RP), the riser extended (RE) and the riser supportive (RS) are formed in whole in a honey comb appearance, and they have high strengths, which characteristics help make the compound bow lighter.

Figure 10C:
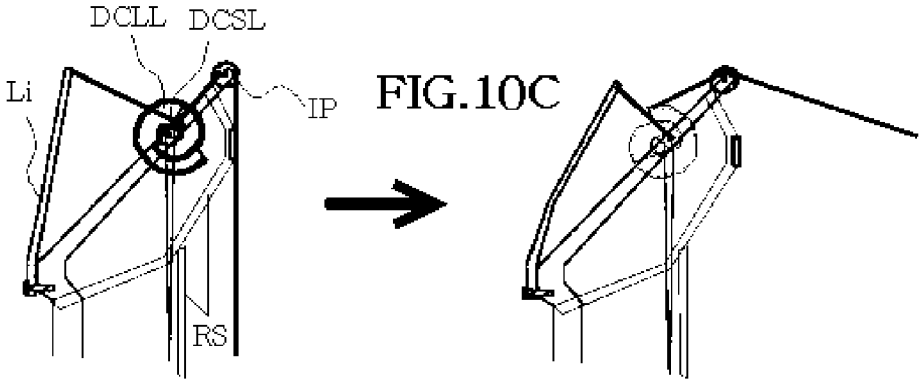

In the present invention, a small and light cam, as shown in FIG. 10B, might be positioned at an end portion of the limb (Li) which moves at the time of shooting; however the cam which has a certain weight heavy enough to interfere with the motion of the limb (Li) is positioned at the riser extended (RE) as shown in FIG. 10A or FIG. 10C, thus making the motion of the limb (Li) smooth. The cam positioned at the riser extended (RE) is thick, so it is stable, and since it has a small radius, it is not affected a lot by an inertia force during the rotation.

In the present invention, the buss cable can be installed past out of the flying direction of the arrow as shown in FIG. 4 without cable guard and is installed at the cam of the riser extended (RE), not a flexible limb (Li), so the nock travel is reduced.

INDUSTRIAL APPLICABILITY

The present invention is applied to the compound bow and the compound crossbow for the purpose of hunting, sports, lope shooting for lifesaving.

The invention claimed is:

1. A small-scale compound bow, comprising:
- a riser;
- a pair of riser extended (RE) which are extended from the riser;
- a pair of limbs (Li);
- a pair of buss cables;
- an idler pulley (IP) which is installed at an end portion of the riser extended (RE);
- a differential cam large lobe (DOLL) which is installed at the riser extended (RE) and rotates more than 270°;
- a differential cam small lobe (DCSL) which rotates together with the differential cam large lobe (DOLL); and
- a synchronizing pulley (SP) which rotates together with the differential cam small lobe (DCSL).

2. A small-scale compound bow, comprising:
- a riser;
- a pair of riser extended (RE) which are extended from the riser;
- a pair of limbs (Li);
- an idler pulley (IP) which is installed at an end portion of the riser extended (RE);
- a differential cam large lobe (DOLL) which is installed at an end portion of the limb (Li) and rotates more than 270°;
- a differential cam small lobe (DCSL) which rotates together with the differential cam large lobe (DOLL); and
- a synchronizing pulley (SP) which rotates together with the idler pulley (IP).

3. A small-scale compound bow, comprising:
- a riser;
- a pair of riser extended (RE) which are extended from the riser;
- a pair of limbs (Li);
- a Y-pulley (YP) which is installed at an end portion of the riser extended (RE) and rotates more than 360';
- a lateral pulley (LP) which is attached to a lateral side of the Y-pulley (YP);
- a differential cam which is installed at the riser extended (RE); and
- a synchronizing pulley (SP) which rotates together with the differential cam.

4. A small-scale compound bow, comprising:
- a riser;
- a pair of limbs (Li);
- a Y-cam large lobe (YCLL) which is installed at an end portion of the limb (Li) and rotates more than 270°; and
- a differential cam small lobe (DCSL) which is attached to the Y-cam large lobe (YCLL).

5. A small-scale compound bow according to claim 4, wherein there are provided two cams which are formed by symmetrically dividing the Y-cam into two parts instead of adapting the differential cam small lobe (DCSL).

6. A small-scale compound bow, comprising:

a riser;

a pair of limbs (Li);

a Y-pulley (YP) which is installed at an end portion of the limb (Li) and rotates more than 270°; and a Y-cam small lobe (YCSL) which is attached to the Y-pulley (YP).

7. A small-scale compound bow according to claim 6, wherein there is provided a differential cam small lobe (DCSL) instead of adapting the Y-cam small lobe (YCSL).

8. A small-scale compound bow, comprising:

a riser;

a pair of riser extenders (RE) which are extended from the riser;

a pair of limbs (Li);

a pair of buss cables; and a synchronizing pulley (SP) which has an axle (Ax) at the riser extended (RE) and rotates more than 270°.

* * * * *